US010801238B1

(12) United States Patent
Cox et al.

(10) Patent No.: US 10,801,238 B1
(45) Date of Patent: Oct. 13, 2020

(54) DOOR STOP

(71) Applicant: ABY Enterprise, LLC, Hampton Falls, NH (US)

(72) Inventors: Robert Cox, Salisbury, MA (US); Yash Patel, Hampton Falls, NH (US); Alexander Paul Bond, Hampton Falls, NJ (US)

(73) Assignee: ABY Enterprise, LLC, Hampton Falls, NH (US)

( * ) Notice: Subject to any disclaimer, the term of this patent is extended or adjusted under 35 U.S.C. 154(b) by 0 days.

(21) Appl. No.: 16/881,152

(22) Filed: May 22, 2020

(51) Int. Cl.
*E05F 5/02* (2006.01)
*E05C 17/54* (2006.01)
*E05C 17/00* (2006.01)

(52) U.S. Cl.
CPC ..... *E05C 17/54* (2013.01); *E05C 17/025* (2013.01); *E05Y 2900/132* (2013.01)

(58) Field of Classification Search
CPC ..... E05D 11/06; E05D 11/10; E05D 11/1007; E05D 11/1028; E05D 11/1014; E05D 2011/10; E05D 2011/1028; E05D 2011/1092; E05D 11/0054; Y10T 16/61; Y10T 16/551; E05Y 2201/28; E05Y 2201/224; E05Y 2900/132; E05F 5/06; E05C 17/00; E05C 17/025; E05C 17/54
See application file for complete search history.

(56) References Cited

U.S. PATENT DOCUMENTS 3,325,854 A * 6/1967 Steigerwald ..... E05C 17/025 16/375
5,044,681 A * 9/1991 Neighbors ..... E05C 17/025 16/319
5,450,652 A * 9/1995 Webb ..... E05C 17/025 16/82
5,511,837 A * 4/1996 Dempsey ..... E05C 17/025 16/319
5,680,675 A * 10/1997 Davis ..... E05C 17/025 16/83
6,831,688 B2 * 12/2004 Lareau ..... G01J 3/0256 348/272
7,559,114 B2 * 7/2009 Ranilovich ..... E05C 17/025 16/374
7,904,992 B2 3/2011 Agster et al.
8,863,561 B2 * 10/2014 Orlov ..... E05C 19/182 16/375
8,869,451 B2 * 10/2014 Belyea ..... E06B 7/362 16/82
9,127,489 B2 * 9/2015 Orlov ..... E05C 17/025
10,196,848 B1 * 2/2019 Fortmann ..... E05F 5/06
2010/0038921 A1 * 2/2010 Kirkham ..... E05D 11/00 292/343
2012/0043770 A1 * 2/2012 Lau ..... E05C 17/025 292/343

* cited by examiner

*Primary Examiner* — Chuck Y Mah
(74) *Attorney, Agent, or Firm* — Elmore Patent Law Group, P.C.; Carolyn S. Elmore

(57) ABSTRACT

A door stop device suitable for propping open doors that has high strength, durability, safety and convenience is described herein. The device is characterized by a convenient bar recessed between two wings. The design permits a user to safely engage the door stop over the hinge of an open door while the wings protect the user's hand and fingers and props the door open.

6 Claims, 3 Drawing Sheets

DOOR STOP

BACKGROUND OF THE INVENTION

It is customary to prop a door open in a hotel setting while housekeeping and maintenance service a room. The doors used in these settings are heavy and are equipped to close automatically. A number of door stops have been designed. One such design is a triangular block characterized by a hook that fits over and engages a door hinge from the inside of an open door. See U.S. Pat. No. 7,904,992. However, the device is difficult to manage and has resulted in serious injuries by pinching fingers and hands while placing or removing the device. Therefore there is a continuing need to design safe and easy to use door stops.

SUMMARY

The invention relates to a door stop device suitable for propping open doors that has high strength, durability, safety and convenience and is described herein. The device, the Door Wing' stop is characterized by a convenient bar recessed between two wings or bases. The design permits a user to safely engage the door stop over the hinge of an open door while the bases, or wings, protect the user's hand and fingers and props the door open.

The invention therefore includes a door stop comprising:

a. a first planar base having a first internal surface, a first external surface, a first proximal length, a first distal portion, a first top portion and a first bottom portion;

b. a second planar base having a second internal surface, a second external surface, a second proximal length, a second distal portion, a second top portion and a second bottom portion;

c. said first proximal length and said second proximal length are connected to form an axis such that the first internal surface and second internal surface form an acute angle along said axis and that the first top portion and second top portion create a top plane, d. a hook extending from the first proximal length away from the first planar base and configured to receive a door hinge exposed in an open door, e. a rigid bar connecting the first distal portion and the second distal portion, the rigid bar placed in a plane below the top plane.

BRIEF DESCRIPTION OF THE FIGURES

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
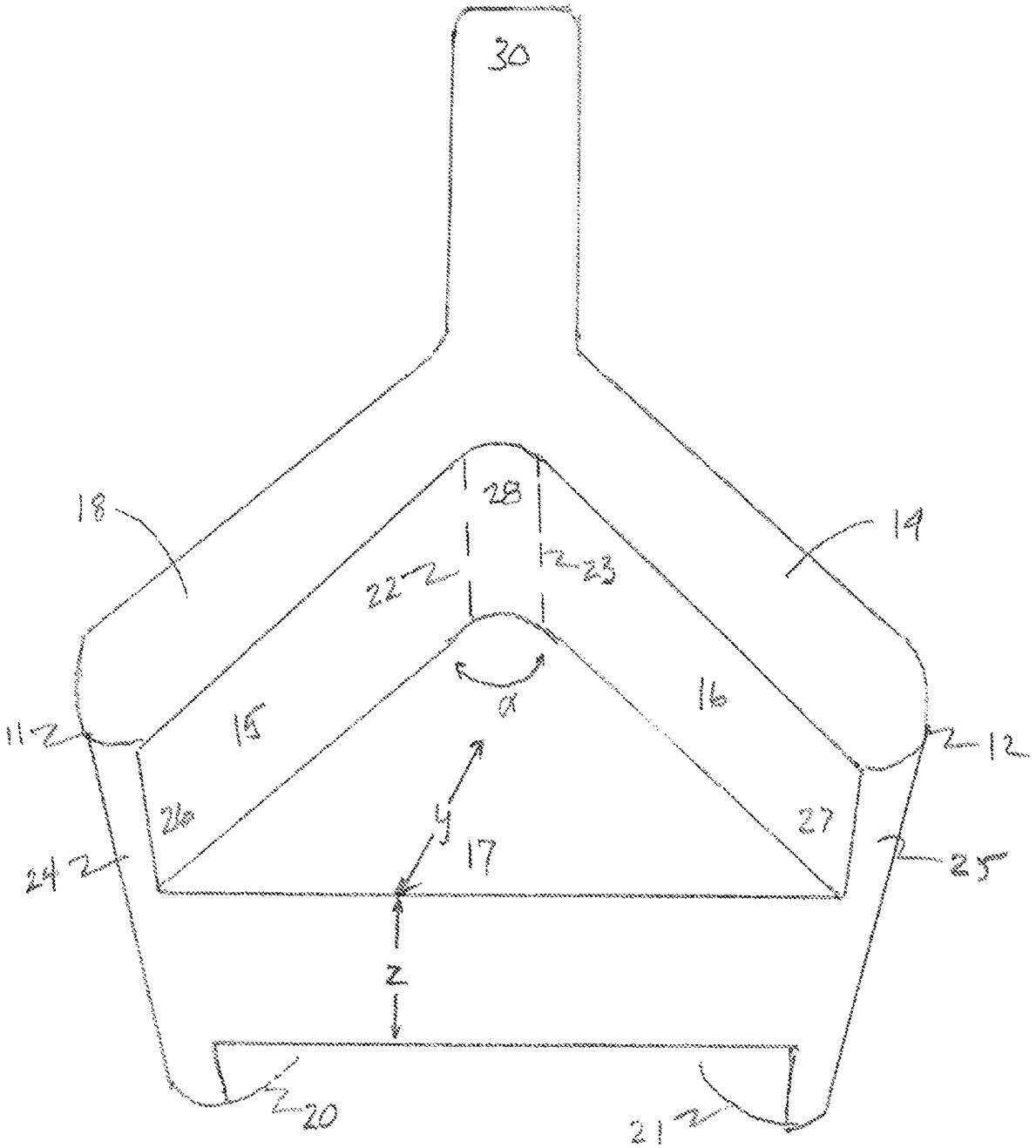
FIG. 1 illustrates a top perspective view of a door stop of the invention.

The invention therefore relates to a Door Wing™ door stop or device. The device comprises two planar bases connected to form a wedge, or prism, that can be placed between an internal face of an open door and the proximal face of a door frame or, in other words, between internal faces of an open door hinge attached to a door and door frame. On the exterior of the wedge, at its apex, is a hook that extends over and beyond a pin of the open door hinge. When the hook is engaged over the hinge, or hinge pin, the wedge props open the door. At the bottom, or base, of the wedge, located distally from the hinge pin is a rigid bar that engages the two planar bases. The bar is configured to provide strength to the wedge such that the closing door does not cause the wedge to collapse. The bar also provides a handle for a user to grasp and place or remove the door stop. Typically, the bar is placed at or near the distal end of the planar bases, relative to the apex of the wedge or the length joining the two bases. The bar is also typically placed below the plane created by the top edges of the two planar bases. Recessing the bar below the two planes allows for additionally safety for the user. In this embodiment, the planar bases serve to protect the user's hands and fingers during placement and removal of the door stop. Therefore, the device of the invention can be typically described as having two planar bases that join to form a wedge or prism, a hook extending therefrom that is configured to receive a hinge pin of an open hinge and a rigid bar that provides a handle for a user and strength for the wedge. Further to clarify the terminology and geometry of the basic device, it has the appearance of a wedge or prism. The word prism is used in the geometrical sense and which can be characterized by 3 rectangular sides, and two opposing triangular faces (albeit, one rectangular side of the prism of this device is not a solid rectangular surface but is substantially open).

Turning to the figures, the device comprises a first planar base 11 and a second planar base 12. The first planar base 11 is characterized by an external surface, or first external surface, 13. Similarly, the second planar base 12 is characterized by an external surface, or second external surface, 14. While each planar base is typically characterized by a single external surface, for example, the adjectives "first" and "second" are used herein for clarity to identify the planar base each external surface belongs to. These surfaces are typically flat, or planar, as most hinge plates, door edges and door frames are flat or planar, and planar surfaces will provide greater surface contact between the door stop and the hinge plate, for example. However, it is possible to devise a device which has other geometries, such as ridged planes, concave or convex surfaces.

The first planar base 11 is also characterized by an internal surface, or first internal surface, 15, while the second planar base is characterized by an internal surface, or second internal surface, 16. The nature of the geometry of these surfaces is not critical, although a planar geometry can be convenient. The geometry of the internal surfaces are typically selected to avoid interference with the user's access to the rigid bar 17.

The first planar base and second planar base are also be characterized by other surfaces typical to cuboids. For example, the first planar base can have a first top surface 18 and the second planar base can have a second top surface 19. Similarly, the first planar base can have a first bottom surface 20 and the second planar base can have a second bottom surface 21.

The first planar base can have a proximal length, or first proximal length, 22, while the second planar base can also have a proximal length, or second proximal length, 23. As can be seen in FIG. 1, these lengths are characterized as proximal as these two edges of the planar base are connected, or joined, along their lengths and, therefore, are proximal to each other. This connection, or joinder 28, results in the formation of an angle, preferably an acute angle, defined by the internal surfaces. The angle (Φ) created by the connection of the proximal lengths and defined by the internal surfaces is between about 5 and about 180 degrees, more preferably between about 5 and 75 degrees, such as between about 25 and about 43 degrees. In general, each proximal length is substantially linear, creating a leading edge or apex of a wedge or prism. However, it is possible to use proximal lengths that are curved or curvilinear so long as that curve does not substantially interfere with the door stop's engagement with a hinge.

In addition, the first planar base can have a distal edge, or first distal edge, 24, while the second planar base can also have a distal edge, or second distal edge, 25. The distal edges can optionally be linear, however as these edges are distal to the hinge, the geometry is not critical to avoid interference with engagement.

Due to the geometry created by the connection of the first and second planar bases, the internal surfaces of the bases are opposing with areas or portions of each internal surface that is adjacent to, proximal to or distal from the joinder 28. Thus, the first internal surface can have a distal portion, or first distal portion, 26, while the second internal surface can also have a distal portion, or second portion, 27. The distal portions can be located adjacent to or near the distal edges of each planar base. The distal portion is typically sufficiently removed from the joinder of the bases to permit an adult human hand or one or more fingers to fit between opposing portions.

As described above, a rigid bar 17 connects the first distal portion to the second distal portion. The rigid bar 17 can be located along or in a same plane as defined by the distal edges, as shown, or can be recessed into an interior volume of the device. Typically, the rigid bar is located below a plane created by the first and second top surfaces 18, 19 (i.e., the "top plane"). Placement below the top plane ensures the planar bases, wings, protects the user's hands from a closing door during placement or removal of the device. For example, the rigid bar 17 can preferably be located at least about 1 cm, such as about 2 cm below the top plane.

Figure 2:
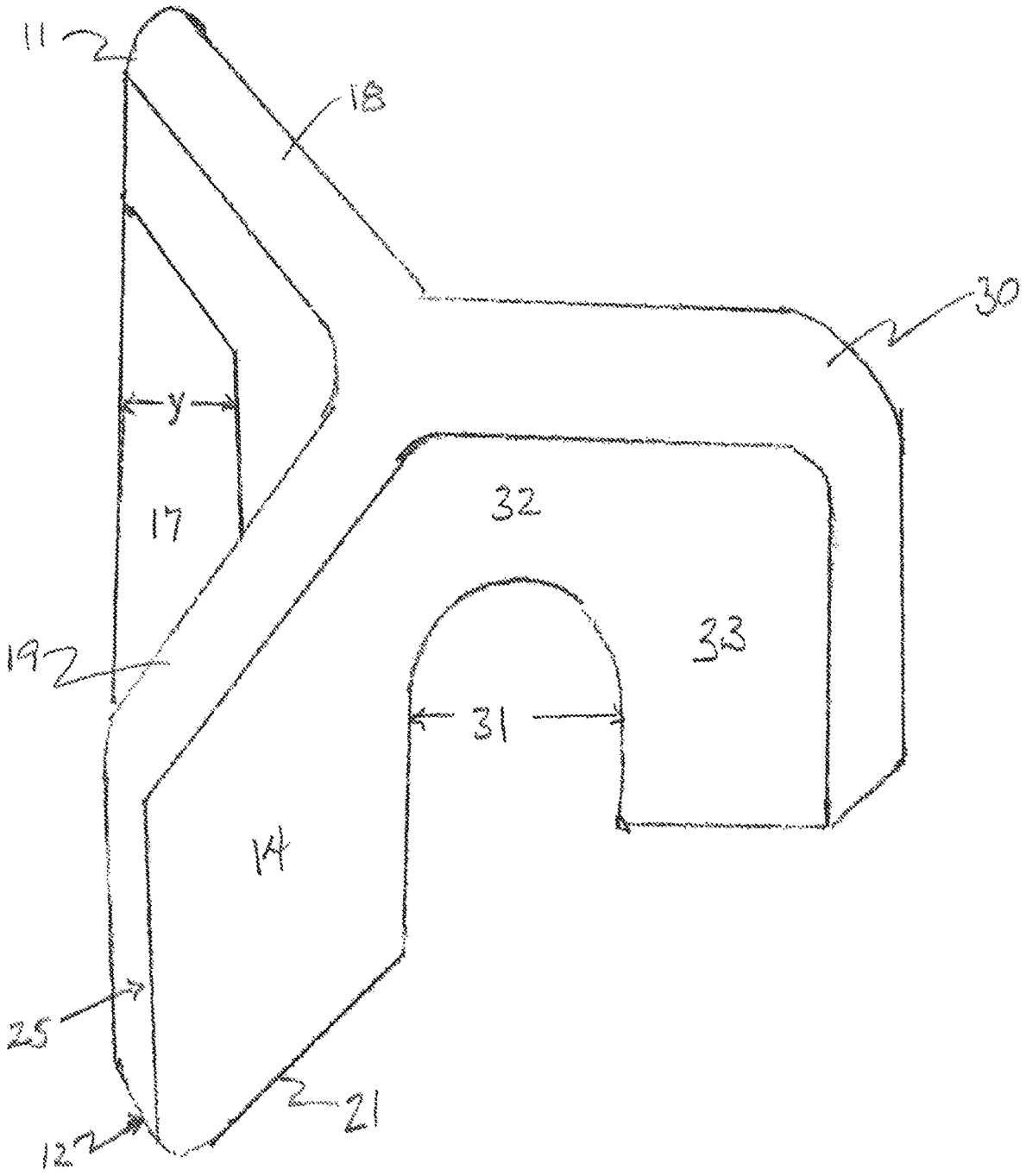
FIG. 2 illustrates a side perspective view of a door stop of the invention.

Typically, the rigid bar 17 has a length (the distance between opposing distal portions of the internal surfaces) which accommodates an adult hand or several fingers. Thus, the length of the rigid bar 17 can be less than about 10 cm, such as less than about 7 cm, preferably about 5 cm, as measured at its longest point. The width or diameter (the distance, y) can be the distance from the plane created by the first and second distal edges and the joinder 28 of the internal surfaces (FIG. 1). Typically, the distance, y, can be less than 75%, preferably about 50% of the distance from the plane created by the first and second distal edges and the joinder 28 of the internal surfaces (FIG. 2). Increased width improves durability and rigidity of the device when under pressure of a heavy industrial door. However, it is desirable to maintain an area more proximal to the joinder for the user's fingers to comfortably and securely grasp the rigid bar. Similarly, the height (the dimension parallel to the orthogonal to the width and length, z) of the rigid bar can be less than about 5 cm, such as less than about 3 cm, preferably about 1 cm. Increasing height, z, can increase durability and strength. However, it is desirable to maintain a height that allows comfortable and secure grasping.

As can be readily seen, the optimal placement of the rigid bar 17 is a matter of geometry and is related to the angle at the joinder 28. A very narrow angle (e.g., 5 degrees) will require a greater distance than a greater angle, e.g. 43 degrees, relative to the joinder.

The surface area of each surface defines the size of the device and informs the placement of the rigid bar 17. The overall size of the device can be conveniently made to be less than 15 cm×15 cm×15 cm, although larger devices can be made. Each proximal length, which typically defines the height of the device, can be less than about 15 cm, such as less than about 10 cm, preferably about 5 cm. Typically, each top surface can be less than about 15 cm, such as less than about 10 cm, preferably about 4 cm. The top surface can be longer to allow a wider access at the distal edge, which is directly related to the angle.

The width of each base (the dimension parallel to the top plane) can also be selected to improve strength and durability of the device. Wider bases provide increased strength but also increase the amount of material required and, thereby the cost. Devices with satisfactory durability and strength have been made from aluminum with a thickness of about 1 cm.

The device is configured with a hook 30 to engage with a door hinge. The term "hook" is intended to embrace a member that extends from the first, second or both bases and away from the joinder along the proximal lengths of the bases and forms a channel between the member and bases that can receive a hinge in an opened door. In FIG. 2, the hook is illustrated as extending from the center of the joinder along a central axis drawn symmetrically between the opposing internal surfaces. In other embodiments, it is possible for the hook to extend asymmetrically from a single base. Thus, the invention contemplates a hook 30 extending from the first proximal length away from the first planar base, and, optionally, both proximal lengths away from both planar bases and configured to receive a door hinge exposed in an open door. The hook should extend for a distance that is sufficient to clear the hinge but not so long as to be unstable after the device is released. The inventors have found that a hook extending about 5 cm is sufficient.

Figure 3:
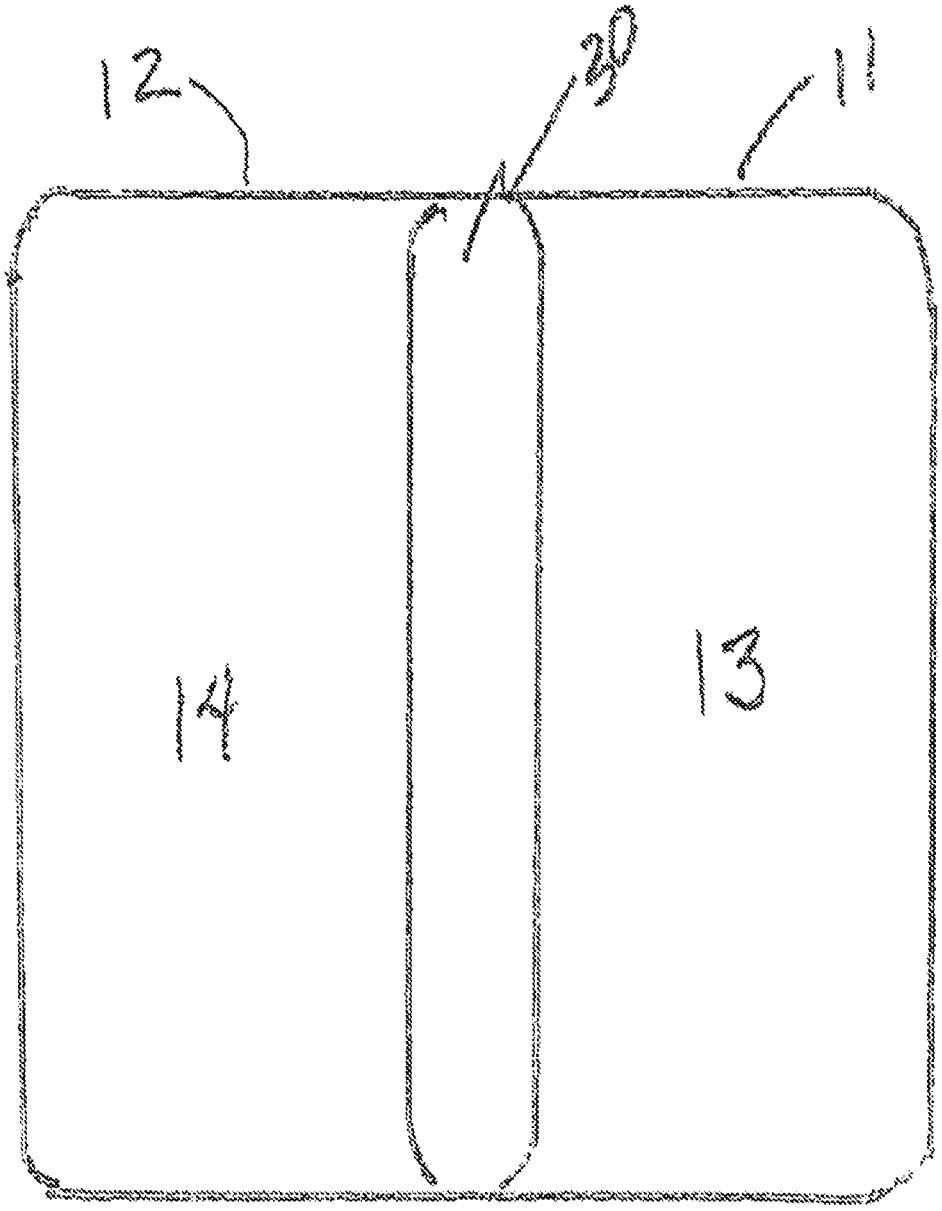
FIG. 3 illustrates a front view of a door stop of the invention.

In FIG. 3, one embodiment of a hook 30 is illustrated in a front view of the device. Here the hook is shown as having substantially the same height as the proximal lengths or bases, discussed above. Of course, other heights can be successful. Using the same height can facilitate manufacturing and packaging.

FIG. 2 illustrates one possible geometry or shape for the hook 30. As clearly shown, the hook 30 extends away from the proximal lengths and then turns and becomes substantially parallel to the proximal edges, thereby forming a recess or channel 31 which can receive a hinge pin. In FIG. 4, the hook 30 extends away from the proximal lengths with a top member 32 that arches to form an arm 33. FIG. 2 illustrates the embodiment where the top member 32 is flush with the top plane and molded to the bases. However, the top member can also be secured to the top surfaces of the base. The top member can also be secured, e.g., by screws or rivets, to the external surface of one or both plates. The arm 33 is illustrated as forming an arch, however, other geometries, such as a rectangular channel, can be used. The arm 33 is also illustrated as running parallel to the proximal edges. A parallel geometry is preferred, but non-parallel geometries can also be used.

It is desirable that the Door Wing™ be symmetrical along the axis created by the proximal lengths and extending between the opposing internal surface and through the hook. Symmetrical designs can carry the load of a heavy door evenly and prevent unnecessary damage to the door and/or frame.

The Door Wing™ can be made from a wide variety of materials. For example, producing the device from a solid block of aluminum provides superior durability and strength and is light weight. The device can also be made of durable plastics or resins, such as polyethylene terephthalate (PET), polycarbonate, polypropylene, oriented polystyrene (OPS), biaxially oriented polypropylene (BOPP), polyvinyl chloride (PVC), polyester, acrylic, polystyrene, rigid polyvinyl chloride (RPVC) polyester, polyethylene, clear acetate plastic, acrylonitrile-butadiene-styrene (ABS), and mixtures thereof. The door stop can be molded or extruded or machined. In other embodiments, each planar base, rigid rod and hook can be manufactured separately and then fastened or secured, for example, by welding or with screws or rivets.

Additional optional features are also possible. The door stop can be equipped with a device that permits the door stop to be tracked, for example to monitor the user or deter theft. It can be coated with an antimicrobial surface or with a frictional surface.

The term "about" typically refers to a value that is within an acceptable error range for the particular value as determined by one of ordinary skill in the art, which will depend in part on how the value is measured or determined, i.e., the limitations of the measurement system. For example, "about" can mean within 1 or more than 1 standard deviation per the practice in the art. Alternatively, "about" can mean a range of up to 20%. Furthermore, particularly with respect to biological systems or processes, the terms can mean up to an order of magnitude or up to 5-fold of a value. When particular values or compositions are provided in the application and claims, unless otherwise stated, the meaning of "about" should be assumed to be within an acceptable error range for that particular value or composition.

While this invention has been particularly shown and described with references to preferred embodiments thereof, it will be understood by those skilled in the art that various changes in form and details may be made therein without departing from the scope of the invention encompassed by the appended claims. It should also be understood that the embodiments described herein are not mutually exclusive and that features from the various embodiments may be combined in whole or in part in accordance with the invention.

What is claimed is:

1. A door stop comprising:

a. a first planar base having a first internal surface, a first external surface, a first proximal length, a first distal portion, a first top surface and a first bottom surface;

b. a second planar base having a second internal surface, a second external surface, a second proximal length, a second distal portion, a second top surface and a second bottom surface;

c. said first proximal length and said second proximal length are connected to form a joinder such that the first internal surface and second internal surface form an acute angle along said joinder and that the first top surface and second top surface create a top plane, d. a hook extending from the first proximal length away from the first planar base and configured to receive a door hinge exposed in an open door, wherein the hook consists of a member that extends from the first planar base, second planar base or both and away from the joinder along the first proximal length and second proximal length and forms one channel between the member and the first planar base and second planar base, e. a rigid bar connecting the first distal portion and the second distal portion, the rigid bar preferably located in a plane below the top plane.

2. The door stop of claim 1, wherein the door stop is manufactured from a material selected form the group consisting of aluminum, polyethylene terephthalate (PET), polycarbonate, polypropylene, oriented polystyrene (OPS), biaxially oriented polypropylene (BOPP), polyvinyl chloride (PVC), polyester, acrylic, polystyrene, rigid polyvinyl chloride (RPVC) polyester, polyethylene, clear acetate plastic, acrylonitrile-butadiene-styrene (ABS), and mixtures thereof.

3. The door stop of claim 1, wherein the door stop is symmetrical along the axis created by the first and second proximal lengths and extending between the first and second internal surfaces and through the hook.

4. The door stop of claim 1, wherein the acute angle is between about 5 and about 75 degrees.

5. The door stop of claim 1, wherein the acute angle is between about 25 and about 43 degrees.

6. The door stop of claim 1 having dimensions less than 15 cm×15 cm×15 cm.

* * * * *